US007134366B2

(12) United States Patent
Schuh

(10) Patent No.: US 7,134,366 B2
(45) Date of Patent: Nov. 14, 2006

(54) MULTI-PURPOSE PLIERS

(76) Inventor: Anthony E. Schuh, P.O. Box 1972, Marshall, TX (US) 75672

( * ) Notice: Subject to any disclaimer, the term of this patent is extended or adjusted under 35 U.S.C. 154(b) by 0 days.

(21) Appl. No.: 11/087,044

(22) Filed: Mar. 22, 2005

(65) Prior Publication Data

US 2006/0213337 A1 Sep. 28, 2006

(51) Int. Cl.
*B25B 7/02* (2006.01)

(52) U.S. Cl. ..... 81/419; 81/424.5

(58) Field of Classification Search ..... 81/415, 81/418, 419, 424.5, 426, 426.5
See application file for complete search history.

(56) References Cited

U.S. PATENT DOCUMENTS 371,476 A * 10/1887 Reese ..... 81/426
519,550 A * 5/1894 Riordan ..... 7/130
520,212 A * 5/1894 McKinzie ..... 294/118
573,313 A * 12/1896 Tiner ..... 81/426
591,720 A * 10/1897 Armstrong ..... 81/426
667,411 A * 2/1901 Vaughan et al. ..... 30/226
768,832 A * 8/1904 Van Horn ..... 81/415
1,176,604 A * 3/1916 Sanders ..... 81/426.5
1,866,771 A * 7/1932 Johnson ..... 81/426
1,891,865 A * 12/1932 Beck ..... 81/407
4,920,593 A * 5/1990 Finn ..... 7/127
4,987,626 A * 1/1991 Montgomery et al. ..... 7/127
5,007,312 A * 4/1991 Bailey ..... 81/426.5
5,014,379 A * 5/1991 Hull et al. ..... 7/127
5,119,520 A * 6/1992 Finn ..... 7/127
5,327,602 A * 7/1994 Stenger ..... 7/125
5,910,174 A * 6/1999 Finn ..... 7/127
2002/0069729 A1* 6/2002 Anderson et al. ..... 81/440

* cited by examiner

*Primary Examiner*—David B. Thomas
(74) *Attorney, Agent, or Firm*—Timothy M. Barlow

(57) ABSTRACT

A multi-purpose pliers includes a pair of lever arms pivotally joined at a pivot. Each lever arm includes a handle end and a jaw end. The jaw ends comprise a plurality of graduated engagement positions to engage a range of fastener sizes. The graduated engagement positions include a plurality of stepped flats or angled notches for square or hexagonal fasteners or other with parallel sides. The handles and jaws may be temporarily fixed into position to simulate a box end wrench with parallel jaws. The pivot includes an adjustable joint with at least two pivot positions. Each of the handle ends may include a driver tip, such as a screwdriver, concealed beneath a removable grip. The driver tips are interchangeable.

16 Claims, 3 Drawing Sheets

MULTI-PURPOSE PLIERS

BACKGROUND OF THE INVENTION

1. Field of the Invention

The present invention relates to multi-purpose pliers and wrenches. In particular, the present invention relates to a pliers and wrenches having a single pair of jaws for securely accepting a range of fasteners without adjusting the jaws.

2. Description of the Related Art

There are many varieties of pliers and wrenches on the market today. There are pliers and wrenches made to satisfy dozens of special uses and many more for general use. Wrenches are often adjustable, with worm screws or other means, but once the wrench is adjusted as desired, it stays in that desired setting. Adjustment often requires two hands, or awkward manipulation with one hand. Many other wrenches have no provision for adjustment. The end is fixed and will accept only one size of fastener.

Pliers offer a unique set of limitations. By their nature, pliers are adjustable. Their jaws are virtually infinitely adjustable due to the pivoting nature of the jaws. Within their design limitations, pliers can be adjusted to fit any fastener that can fit within the jaws, but a pliers' holding strength is limited to the strength of the user. If the user does not have a strong hand or grip, then the jaws will open slightly as user attempts to turn the fastener. This results in the corners of the fasteners becoming rounded off. Usually, a fastener with rounded corners should be replaced, which is a hassle must users are not prepared for.

Additionally, the designs of most pliers require that the jaws are parallel at only one setting. Thus, only one particular size of fastener can be engaged squarely. Any other sizes of fasteners will be gripped by pliers jaws that are not parallel. Non-parallel jaws are a big contributor to rounded corners on the fasteners.

Therefore, there has been and continues to be a need for a wrench that adjusts quickly, like pliers, or a pliers that grips like a wrench, having multiple sizes of parallel openings between the jaws for securely engaging a variety of fasteners, without rounding or damage to the fastener.

SUMMARY OF THE DISCLOSURE

A multi-purpose pliers includes a pair of lever arms pivotally joined at a pivot, where each lever arm has a handle end and a jaw end. The jaw ends include a plurality of graduated engagement positions to engage a range of fastener sizes. The graduated engagement positions provide simultaneous multiple jaw positions to engage multiple sizes of fasteners, whether SAE or Metric, square or hexagonal. Virtually any fastener can be engaged, if it has a pair of parallel sides.

A latch mechanism temporarily fixes or locks the jaws into one of several available positions, to prevent the jaws from moving relative to each other. In this manner, the multi-purpose pliers act like a fixed, open-ended wrench, but with multiple fixed engagement positions. The multi-purpose pliers have an adjustable pivot joint, such as a slip joint or a tongue-and-groove mechanism to provide additional sizes for engagement positions. The various engagement position size ranges may or may not overlap, depending on the relative adjustment of the jaws via the adjustable pivot joint. The tool may be used as a wrench or pliers, for maximum convenience to the user. The cushioned handgrips can be removed to reveal tools, such as screwdrivers incorporated into the handles. The jaws may be textured to resist slippage on fasteners. The texture may include serrations, shallow grooves, or stippling.

It is therefore an object of the present invention to provide a multi-purpose pliers that is quicker to adjust and more secure than wrenches with worm screw adjustment mechanisms.

It is another object of the present invention to provide a multi-purpose pliers that is quicker to shift and adjust during use.

It is another object of the present invention to teach a multi-purpose pliers that may be used as a wrench or pliers.

It is another object of the present invention to teach a multi-purpose pliers that offers a unique gripping action compared to ordinary wrenches.

It is another object of the present invention to provide a multi-purpose pliers that offers a wrench with a fastener-gripping action that is unique to pliers.

It is another object of the present invention to provide a multi-purpose pliers that is appropriate for flat-sided, square, or hexagonal fasteners.

It is another object of the present invention to provide a multi-purpose pliers that teaches a lock mechanism for temporarily fixing the jaws in a parallel relationship to each other.

It is another object of the present invention to provide a multi-purpose pliers that accepts a wide range of fasteners sizes within the jaws when the jaws are substantially parallel.

It is another object of the present invention to provide a multi-purpose pliers where each pivot position gives the user a new range of fasteners sizes between the parallel jaws, with or without overlap between the pivot positions.

Finally, it is an object of the present invention to accomplish the foregoing objectives in a simple and cost effective manner.

DETAILED DESCRIPTION OF THE PREFERRED EMBODIMENT

Figure 1:
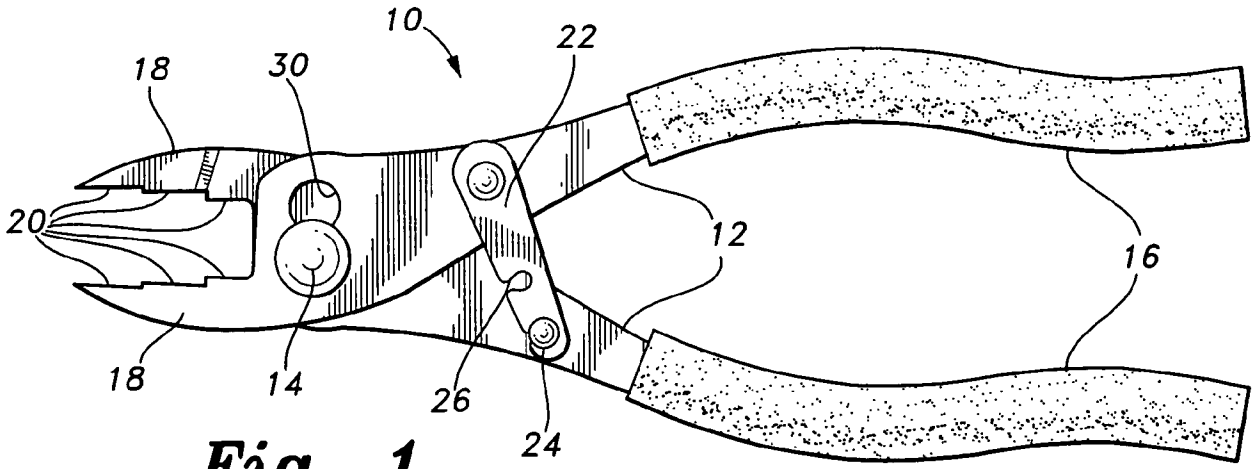
FIG. 1 is a side view of the multi-purpose pliers, in accordance with the present invention.

The following detailed description is of the best presently contemplated modes of carrying out the invention. This description is not to be taken in a limiting sense, but is made merely for the purpose of illustrating general principles of embodiments of the invention.

The present invention provides a multi-purpose pliers that includes a pair of lever arms pivotally joined at a pivot, where each lever arm has a handle end and a jaw end, where the jaw end comprises a plurality of graduated engagement positions to engage a range of fastener sizes. The graduated engagement positions provide simultaneous multiple jaw positions to engage multiple sizes of fasteners, whether SAE or Metric, square or hexagonal.

A latch mechanism temporarily fixes the jaws into one or more positions, to prevent the jaws from moving relative to each other. The multi-purpose pliers act like a fixed, open-ended wrench, but with multiple fixed engagement positions. The multi-purpose pliers have an adjustable pivot joint, such as a slip joint or a tongue-and-groove mechanism to provide additional sizes for engagement positions. The various engagement position size ranges may or may not overlap, depending on the relative adjustment of the jaws via the adjustable pivot joint. The tool may be used as a wrench or pliers, for maximum convenience to the user. The cushioned handgrips can be removed to reveal tools, such as screwdrivers incorporated into the handles. The jaws may be textured to resist slippage on fasteners.

FIGS. 1–4 shows a multi-purpose pliers, in accordance with the present invention. The multi-purpose pliers 10 includes a pair of lever arms 12 pivotally joined at a pivot pin 14. Each lever arm 14 includes a handle end 16 and a jaw end 18. The jaw ends include a plurality of graduated engagement positions 20 to engage a range of fastener sizes. In one embodiment, the plurality of graduated engagement positions 20 are a plurality of stepped flats. The stepped flats 20 permit the user to grab and grip securely to virtually any fastener or other item that has substantially parallel opposing sides, such as a hexagonal bolt or a square nut. The plurality of graduated engagement positions 20 permit the user to grip the fastener with jaws 18 that are substantially parallel. Parallel jaws 18 greatly increase the amount of surface area contact between the jaws 18 and the fastener. Thus, the parallel jaws 18 reduce the likelihood of rounding or damage to the fastener.

The multi-purpose pliers may include a lock mechanism to hold the jaws in a fixed orientation. The lock mechanism includes a pivoting latch 22, a latch pin 24 and one or more adjustment notches 26. The lock mechanism allows the user to releasably lock the graduated engagement positions 20 is a substantially parallel relationship, see FIG. 1. In one embodiment, the graduated engagement positions 20 are parallel when the handles 16 are about one centimeter apart. Other handle gap measurements may be used as well. Such a gap between the handles 16 allows a user to squeeze the handles 16, when the latch 22 is not engaged, without the handles 16 touching and limiting the amount of gripping force transferred to the fastener. This situation could happen if the user has a particularly strong grip and flexes the handles 16. In another embodiment, the engagement positions 20 are parallel just as the handles 16 contact each other.

Figure 2:
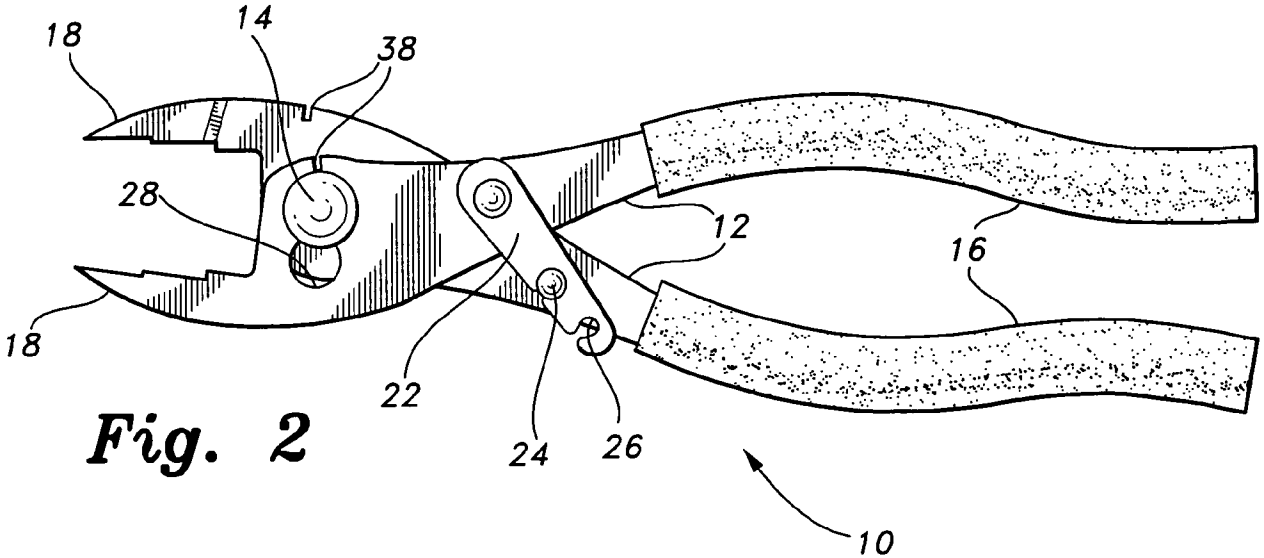
FIG. 2 is a side view of the multi-purpose pliers, in accordance with the present invention.
Figure 3:
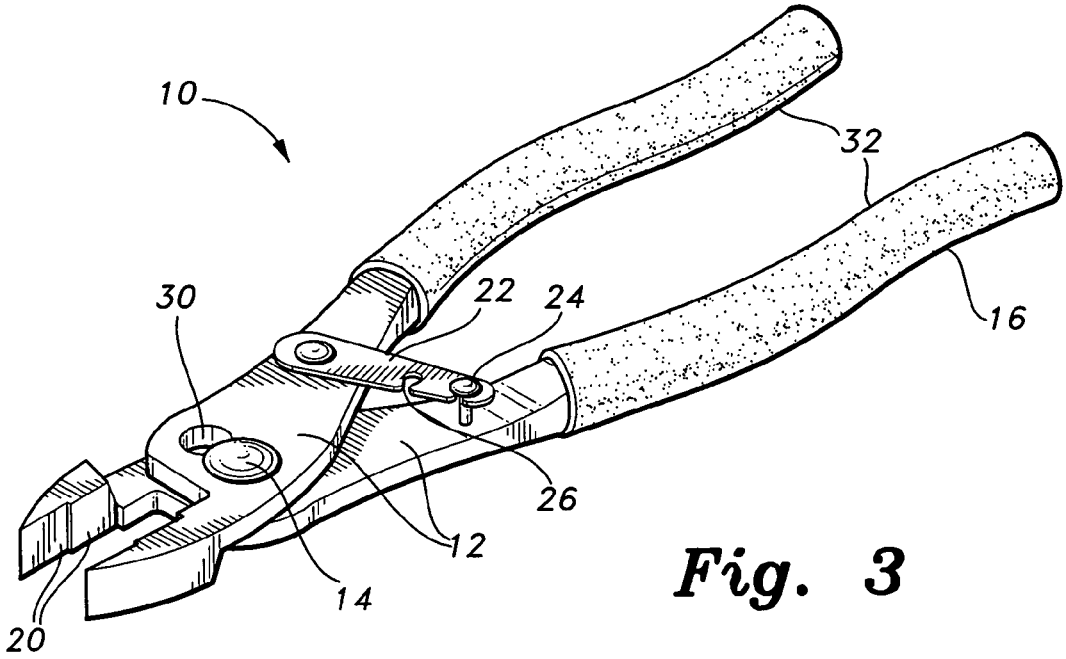
FIG. 3 is a perspective view of the multi-purpose pliers, in accordance with the present invention.

In one embodiment, the pivot pin 14 is part of an adjustable joint. FIG. 1 shows the pivot pin 14 in a narrow adjustment position 28, see FIG. 2. FIG. 2 shows the pivot pin 14 in a wide adjustment position 30, see FIG. 1. The pivot pin 14 obscures the adjustment position 28, 30 that it occupies at that time. Notice that in both FIGS. 1 and 2, the graduated engagement positions 20 are parallel, despite the adjustable joint being in different positions. FIGS. 1–5 show a multi-purpose pliers having an adjustable joint with two pivot positions, in a slip-joint arrangement. Other layouts are equally effective, including tongue and groove joints and other arrangements. The adjustable joint permits the user to widen or narrow the parallel engagement positions 20 to engage various sizes of fasteners. The construction of the adjustable joint determines the range of the engagement positions 20. For example, if the parallel engagement positions have a 1 millimeter graduation, then the engagement positions 20 may properly grip a 6 mm, 7 mm or 8 mm fastener. If the adjustable joint moves the jaws 18 3 mm between adjacent adjustment positions 28, 30, then opening up the joint to the next adjustment position means that the jaws may properly grip 9 mm, 10 mm and 11 mm fasteners. If the joint has more than two adjustment positions, the user needs only to adjust the joint so that the graduated engagement positions 20 are appropriately spaced for his particular fastener. The adjustable joint may be constructed to provide metric spacing, English or SAE spacing, or some compromise between the two systems so that the user is able find an adjustable joint position to keep the parallel engagement positions 20 in a substantially parallel relationship. The adjustable joint may be constructed so that the engagement positions 20 overlap from one adjustment position to the next, or with out any overlap. The adjustable joint may be constructed to provide evenly-spaced adjustment positions.

The lock mechanism is made to complement the adjustable joint feature. The latch 22 includes as many adjustment notches 26 as there are adjustment positions 28, 30 in the adjustable joint. The spacing of the notches 26 permits the user to find a notch 26 to lock the engagement positions 20 in a substantially parallel relationship, no matter which adjustment position 28, 30 is used. This effectively creates an open-ended wrench that acts like a pliers. The gripping surface of the plurality of engagement positions 20 may be smooth, see FIG. 3, or may be serrated to enhance the grip, to FIG. 4. In one embodiment, the jaws 18 may be marked with the sizes of the spacing between the graduated engagement positions 20. Thus, the user will be able to determine which of the engagement positions 20 is appropriate for a given fastener. In addition, the user may use the multi-purpose pliers to measure the size of fasteners or other objects that fit within its jaws 18, when the jaws are substantially parallel.

Figure 4:
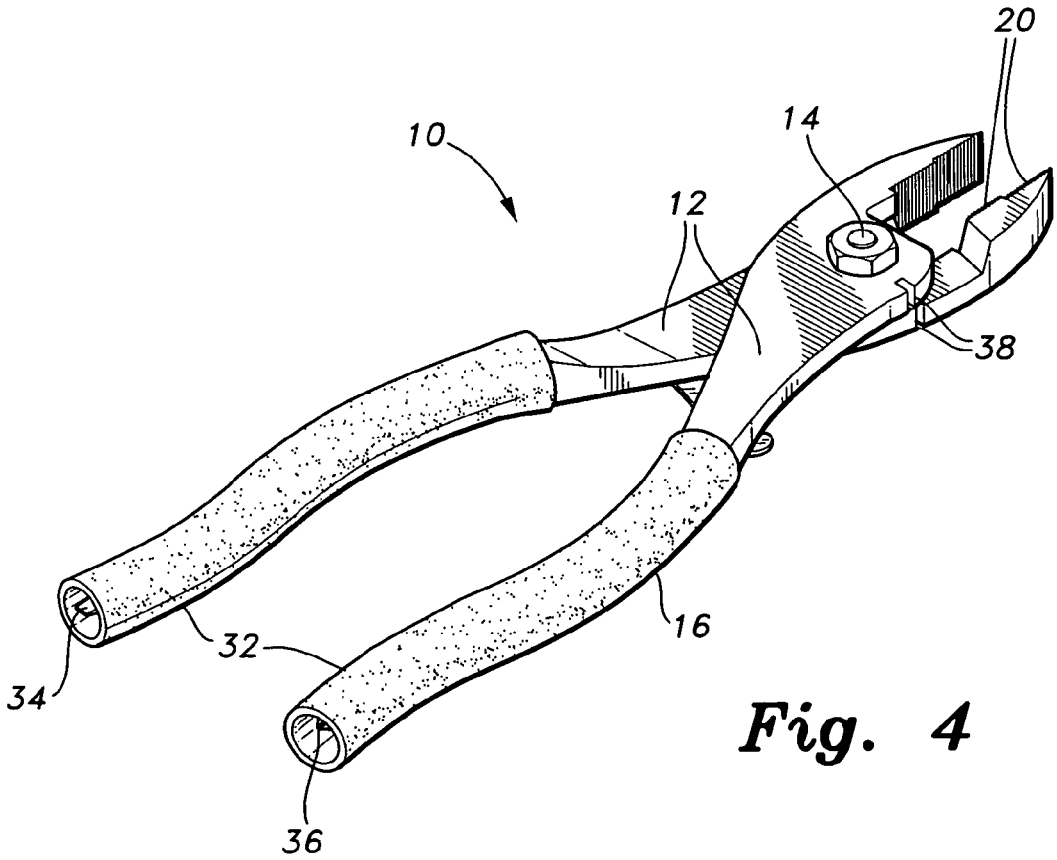
FIG. 4 is a perspective view of the multi-purpose pliers, in accordance with the present invention.

FIG. 4 shows a multi-purpose pliers, where each of the handle ends includes a removable grip 32. Driver tips 34, 36 are visible inside the removable grips 32. A wire cutter 38 is provided to permit the user to cut wire and other small diameter stock.

Figure 5:
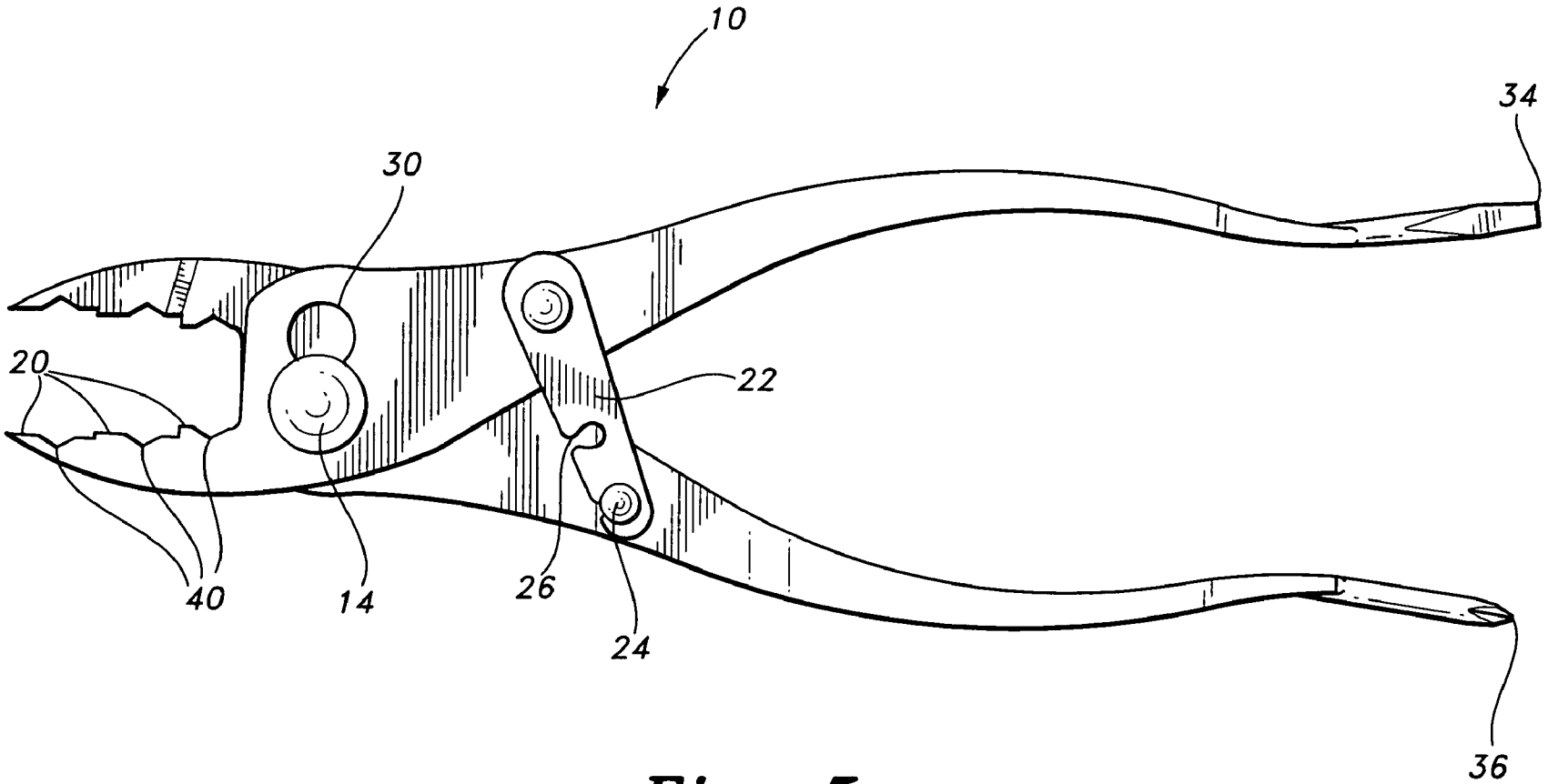
FIG. 5 is a side view of the multi-purpose pliers, in accordance with the present invention.

FIG. 5 is a side view of the multi-purpose pliers with the removable grips 32 removed to clearly show the driver tips 34, 36. A regular screwdriver tip 34 and a Philips driver tip 36 are show. In another embodiment, the driver tips 34, 36 are interchangeable.

A variation on the engagement positions 20 is shown in FIG. 5. Here, the graduated engagement positions 20 include a plurality of angled notches 40. When the angled notches 40 include an angle of about 90 degrees, the engagement positions are particularly suited for gripping square fasteners by the corners. When the angled notches 40 include an angle of about 60 degrees, shown in FIG. 5, the engagement positions are particularly well-suited for gripping hexagonal fasteners by the corners. The angled notches 40 may have a smooth or textured surface.

Thus, the multipurpose pliers is quicker to adjust than wrenches with worm screw adjustment mechanisms, due to the pliers-type mechanism. It is also quicker and easier to shift and adjust during use. The device may be used as an open-ended wrench or pliers. It offers the fastener-gripping action unique to pliers with the torque-transfer capability of a wrench. It works equally well with flat-sided, square, or hexagonal fasteners. A lock mechanism temporarily fixes the pliers' jaws in a parallel relationship to each other. A wide range of fasteners sizes are accepted within jaws when jaws are substantially parallel. Each pivot position gives user a new range of fasteners sizes between jaws, with or without overlap.

While the description above refers to particular embodiments of the present invention, it will be understood that many modifications may be made without departing from the spirit thereof. The accompanying claims are intended to cover such modifications as would fall within the true scope and spirit of the present invention.

NUMERICAL PARTS LIST

10 multi-purpose pliers
12 lever arms
14 pivot pin
16 handle end
18 jaw end
20 graduated engagement positions
22 pivoting latch
24 latch pin
26 adjustment notches
28 pivot pin adjustment position, wide
30 pivot pin adjustment position, narrow
32 removable grip
34 driver tip
36 driver tip
38 wire-cutter notch
40 angled notches

What is claimed is:

1. A multi-purpose pliers, comprising:

a pair of lever arms pivotally joined at a pivot, further comprising a lock mechanism pivotally attached between the pair of lever arms, where each lever arm comprises a handle end; and a jaw end, where the jaw end comprises a plurality of graduated engagement positions distributed regularly along the jaw, each engagement position comprising a symmetrical angled notch indexed to match with the other jaw to create a plurality of partial regular polygonal apertures, the plurality of apertures accepting a range of fastener sizes.

2. The multi-purpose pliers of claim 1, where each of the handle ends comprises a driver tip.

3. The multi-purpose pliers of claim 2, where the driver tips are interchangeable.

4. The multi-purpose pliers of claim 1, where each of the handle ends comprises a removable grip.

5. The multi-purpose pliers of claim 1, where the angled notches include an angle of about 90 degrees.

6. The multi-purpose pliers of claim 1, where the angled notches include an angle of about 60 degrees.

7. The multi-purpose pliers of claim 1, where the graduated engagement positions are substantially parallel when the handles are about one centimeter apart.

8. The multi-purpose pliers of claim 1, where the pivot comprises an adjustable joint with at least two pivot positions.

9. The multi-purpose pliers of claim 8, where the maximum allowable fastener sizes for each of the graduated engagement positions in each of the adjustable pivot positions do not overlap.

10. The multi-purpose pliers of claim 1, where the plurality of graduated engagement positions are serrated.

11. A multi-purpose pliers, comprising:

a pair of lever arms pivotally joined at a pivot, where the pivot comprises an adjustable joint with at least two pivot positions; each lever arm comprising a handle end; and a jaw end, each jaw end having a plurality of graduated engagement positions to engage a range of fastener sizes, where the graduated engagement positions comprise a plurality of stepped flats, where the graduated engagement positions are substantially parallel when a lock mechanism releasably fixes the lever arms into a position.

12. The multi-purpose pliers of claim 11, where the graduated engagement positions comprise a plurality of angled notches.

13. The multi-purpose pliers of claim 12, where the angled notches include an angle of about 90 degrees.

14. The multi-purpose pliers of claim 12, where the angled notches include an angle of about 60 degrees.

15. The multi-purpose pliers of claim 11, where the maximum allowable fastener sizes for each of the graduated engagement positions in each of the adjustable pivot positions do not overlap.

16. The multi-purpose pliers of claim 11, where the plurality of graduated engagement positions are serrated.

* * * * *